US009720435B2

(12) United States Patent
Joffe et al.

(10) Patent No.: US 9,720,435 B2
(45) Date of Patent: Aug. 1, 2017

(54) REFERENCE CURRENT SOURCE

(71) Applicant: ADTRAN, INC., Huntsville, AL (US)

(72) Inventors: Daniel M. Joffe, Huntsville, AL (US); Daniel R. Chandler, Round Rock, TX (US)

(73) Assignee: ADTRAN, Inc., Huntsville, AL (US)

( * ) Notice: Subject to any disclaimer, the term of this patent is extended or adjusted under 35 U.S.C. 154(b) by 0 days.

(21) Appl. No.: 14/980,093

(22) Filed: Dec. 28, 2015

(65) Prior Publication Data

US 2017/0185095 A1 Jun. 29, 2017

(51) Int. Cl.

| | |
|---|---|
| ***G05F 3/04*** | (2006.01) |
| ***G05F 3/08*** | (2006.01) |
| ***G05F 3/16*** | (2006.01) |
| ***G05F 3/20*** | (2006.01) |

(52) U.S. Cl.
CPC ..... *G05F 3/08* (2013.01)

(58) Field of Classification Search
CPC ..... G05F 1/462; G05F 1/463; G05F 1/567; G05F 3/00; G05F 3/20; G05F 3/242; G05F 3/245; G05F 3/247; G05F 3/26; G05F 3/267
USPC ..... 323/311–315
See application file for complete search history.

(56) References Cited

U.S. PATENT DOCUMENTS

| | | | | |
|---|---|---|---|---|
| 2010/0007322 | A1* | 1/2010 | Huang | G05F 3/30 323/312 |
| 2011/0050197 | A1* | 3/2011 | Yuasa | G05F 3/242 323/313 |
| 2011/0261138 | A1* | 10/2011 | Nagumo | G03G 15/326 347/247 |
| 2012/0025801 | A1* | 2/2012 | Hirose | G05F 3/242 323/313 |
| 2013/0002228 | A1* | 1/2013 | Wong | G05F 3/265 323/317 |
| 2014/0103900 | A1* | 4/2014 | Lahiri | G05F 3/24 323/313 |

* cited by examiner

*Primary Examiner* — Adolf Berhane
*Assistant Examiner* — Gary Nash
(74) *Attorney, Agent, or Firm* — Fish & Richardson P.C.

(57) ABSTRACT

Systems, methods, and apparatus for generating a reference current. A reference current source can include a current generator circuit; a first resistance circuit that has a positive temperature dependence; and a second resistance circuit that has a negative temperature dependence. The first resistance circuit and the second resistance circuit can be connected in parallel to the current generator circuit.

11 Claims, 4 Drawing Sheets

SLOPE OF I3 VS. L2/L1 (T=300, K1=7.071)

I3 VS TEMPERATURE

REFERENCE CURRENT SOURCE

BACKGROUND

Integrated circuit (IC) reference current sources are often realized using either an external resistor, or an on chip resistor. However, process tolerance limits of these resistors (i.e., the amount of variation from the nominal value of the resistors) negatively impact the stability of the reference current source. Operating temperature variations can further negatively impact the stability of reference current sources that are realized using an external or on chip resistor.

SUMMARY

This specification relates to IC reference current sources. In general, one innovative aspect of the subject matter described in this specification can be embodied in devices that include a current generator circuit; and a resistance circuit connected to the current generator, wherein the resistance circuit comprises a current controlled resistance circuit. Other embodiments of this aspect include corresponding systems and apparatus.

These and other embodiments can each optionally include one or more of the following features. The resistance circuit can include a voltage controlled resistance circuit that is connected in parallel with the current controlled resistance circuit.

The voltage controlled resistance circuit can include a plurality of MOSFETs. The plurality of MOSFETs can include a first MOSFET having a drain connected to an emitter of a bipolar transistor of the current generator, and having a source connected to ground; a second MOSFET having a drain connected to a voltage source of the current generator and a gate connected to a first current control voltage source; and a third MOSFET having a source connected to ground and a gate connected to a second current control voltage source. A drain of the third MOSFET can be connected to each of a drain of the second MOSFET and a gate of the first MOSFET.

The current controlled resistance circuit can include a plurality of MOSFETs. The plurality of MOSFETs can include a fourth MOSFET having a drain connected to each of the drain of the first MOSFET and the emitter of the bipolar transistor, and having a source connected to the ground; a fifth MOSFET having a source connected to the voltage source of the current generator and a gate connected to the current generator; and a sixth MOSFET having a source connected to ground and a gate connected to each of a gate of the fourth MOSFET, a drain of the fifth MOSFET, and a drain of the sixth MOSFET.

The current controlled resistance circuit can have a positive temperature dependency. The voltage controlled resistance circuit can have a negative temperature dependency. The current controlled resistance circuit and the voltage controlled resistance circuit can be respectively configured so that a combination of the positive temperature dependency and the negative temperature dependency configure the reference current source to be temperature independent. The current controlled resistance circuit and the voltage controlled resistance circuit can be respectively configured so that a combination of the positive temperature dependency and the negative temperature dependency configure the reference current source to have a positive temperature dependence. The current controlled resistance circuit and the voltage controlled resistance circuit can be respectively configured so that a combination of the positive temperature dependency and the negative temperature dependency configure the reference current source to have a negative temperature dependence. The current generator circuit can include a PTAT current generator circuit.

Another innovative aspect of the subject matter described in this specification can be embodied in devices that include a current generator circuit; a first resistance circuit that has a positive temperature dependence; and a second resistance circuit that has a negative temperature dependence, wherein the first resistance circuit and the second resistance circuit are connected in parallel to the current generator circuit. Other embodiments of this aspect include corresponding systems and apparatus.

These and other embodiments can each optionally include one or more of the following features. The first resistance circuit can be a current controlled resistance circuit. The second resistance circuit can be a voltage controlled resistance circuit. An L2/L1 ratio and a p value for MOSFETs of the reference current source can be selected to provide a zero current slope at a given temperature.

Particular embodiments of the subject matter described in this specification can be implemented so as to realize one or more of the following advantages. Implementations of the reference current sources described in this document can provide less than +/−10% variation from the nominal value despite normal process variations. Implementations of the reference current sources described in this document provide a temperature independent reference current. Reference current sources described in this document can be implemented to have a chosen temperature dependence (e.g., a positive or negative dependence on temperature). The reference current sources described in this document provide a stable current output over process variations using either PMOS or NMOS devices regardless of the availability of isolated wells.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

The subject matter described below relates to realizing IC reference current sources. The reference current sources described below can provide currents vary less with standard process parameter variation than those realized using on-chip resistors. In particular, the reference current sources described below use a resistance circuit that depends on the most stable parameters in a standard MOS process (e.g., $\mu_n$ and $C_{ox}$). As discussed below, the reference current sources can be designed to have a specified temperature dependence (e.g., a positive or negative temperature dependence) or to be relatively independent of temperature. These reference current sources provide a stable current source for setting bias currents and/or tuning circuit parameters.

It is often desirable to have a stable voltage, current, and/or resistive reference in an integrated circuit for setting bias currents or for tuning of circuit parameters. Available circuits for reference current generation typically either have poor tolerances (e.g., greater than +/−30%) or require post-fabrication trimming and/or fusing. Also, the typical resistors available in a MOS process have similar tolerance issues. As such, reference current sources realized using available circuits or resistors generally don't provide a sufficiently stable reference current source for purposes of setting bias currents and/or tuning circuit parameters.

A reference current source that depends upon the most stable parameters in a standard MOS process, $\mu_n$ and $C_{ox}$, can provide a reference current that is sufficiently stable for purposes of setting bias currents and/or tuning circuit parameters. In some implementations, these reference current sources include a current controlled resistance circuit. Generally, this current controlled resistance circuit has a positive temperature coefficient. However, the current controlled resistance circuit can be combined with a voltage controlled resistance circuit having a negative temperature coefficient to create a tunable reference current source (i.e., a reference current source that can be tuned to be independent of temperature, or have a positive or negative temperature dependence).

Figure 1:
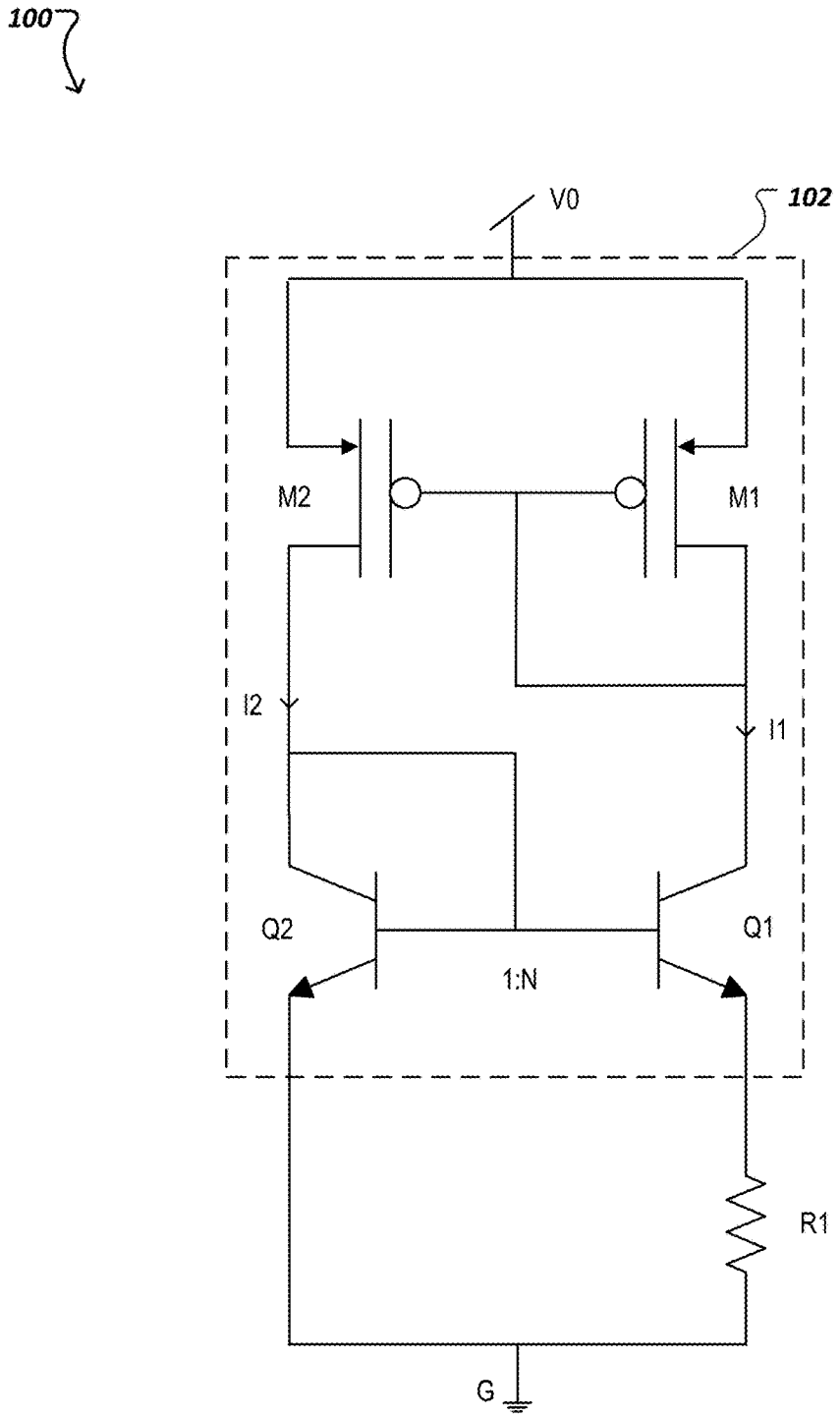
(PRIOR ART) FIG. 1
FIG. 1 is a schematic of an example prior art reference current source.

FIG. 1 is a schematic of an example prior art reference current source 100. The reference current source 100 is a proportional to absolute temperature (PTAT) current source. The reference current source 100 includes a current generator circuit 102 and a resistor R1. The current generator circuit 102 includes the following components: MOSFETS M1 and M2, and bipolar transistors Q1 and Q2, which are interconnected between a source voltage V0 and ground G as shown in FIG. 1.

The reference current source 100 generates a current as provided by relationship (1).

$$I1 = I2 = \frac{k*T}{q*R1}*\ln(N) \tag{1}$$

where, k is Boltzmann's constant;

T is the temperature (in Kelvin);

q is the magnitude of the electrical charge on an electron;

R1 is the resistive value of R1; and

N is the size ratio of Q1 to Q2.

As shown in relationship (1), the current provided by the reference current source 100 depends on the temperature T and the value of R1. Therefore, variations to either (or both) of the temperature or the value of R1 will cause variations in the current provided by the reference current source 100. As such, the process related variance of resistors can lead to large variations in the current provided by the reference current source 100.

Figure 2:
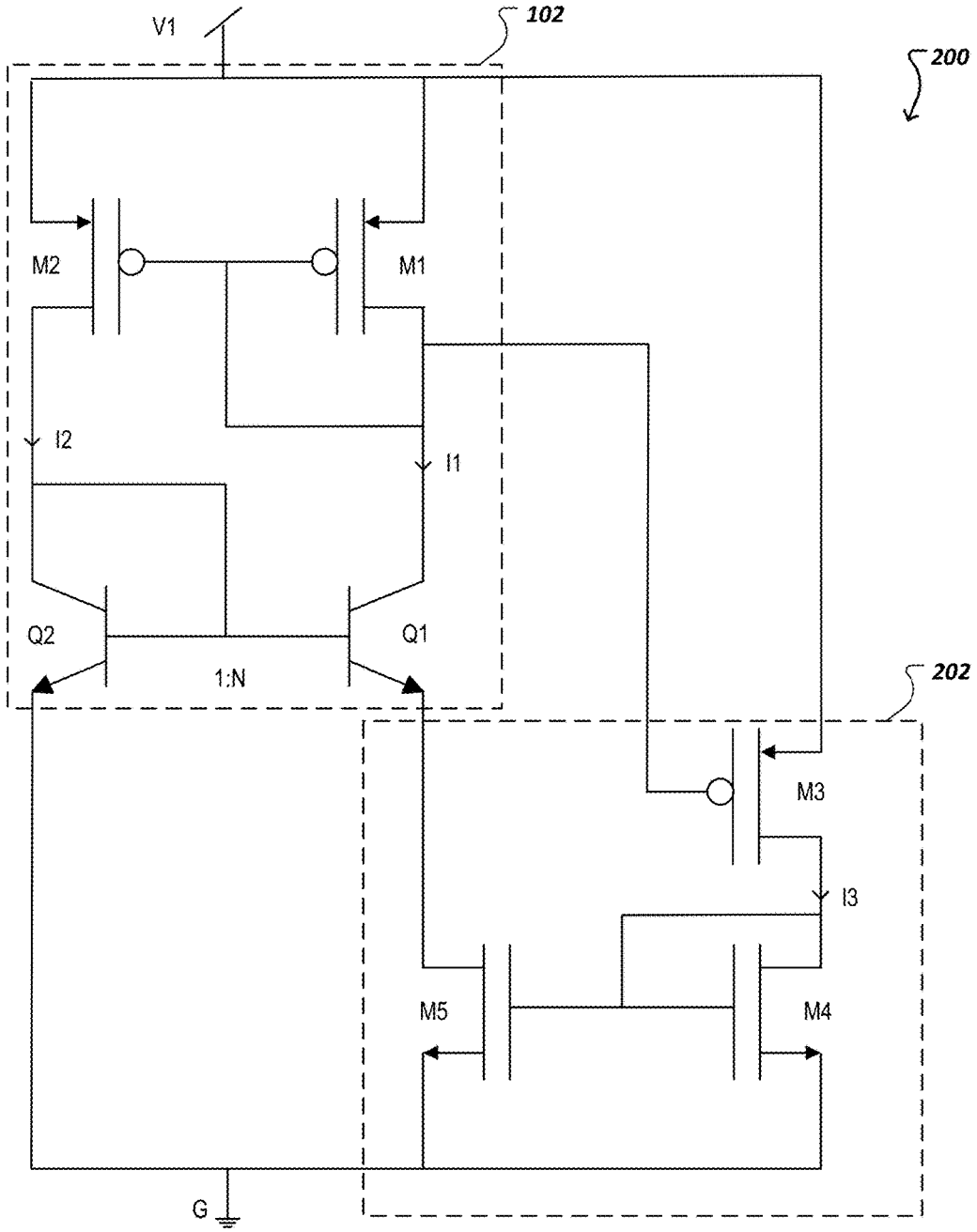
FIG. 2 is a schematic of another example reference current source.

FIG. 2 is a schematic of another example reference current source 200. The reference current source 200 is similar to the current source 100, but includes a resistance circuit instead of the resistor R1. In particular, the reference current source 200 includes a current controlled resistance circuit 202 instead of the resistor R1 that was used in the reference current source 100.

The current controlled resistance circuit 202 includes three MOSFETs M3, M4, and M5, which are interconnected as shown in FIG. 2. More specifically, in the current controlled resistance circuit 202, M5 has its source connected to ground, and its drain connected to the emitter of Q1. The gate of M5 is connected to each of the gate of M4, the drain of M4, and the drain of M3. M4 has its source connected to ground, its gate connected to each of the gate of M5, the drain of M3, and the source of M4. M3 has its source connected to a voltage source of the current generator circuit 102, while its drain is connected to the drain of M4, the gate of M5, and the gate of M4. Meanwhile the gate of M3 is connected to the drain of M1, the collector of Q1, and the gates of M1 and M2.

The resistance provided by the current controlled resistance circuit 202 is provided by relationship (2).

$$RM5 = \frac{1}{\sqrt{2*I1*\beta f}} \tag{2}$$

where,

RM5 is the drain to source resistance of M5 in the current controlled current source 200; and $$\beta f = \mu * Cox\frac{W}{L}$$

where,

μ is the mobility of silicon;

Cox is the Capacitance per unit area of the gate-oxide of M5;

W is the width of the gate of M5; and

L is the length of the gate of M5.

The resistance RM5 shown above can be inserted into relationship (1) in place of R1 to arrive at relationship (3), which provides the current generated by the reference current source 200.

$$I1 = \frac{k*T}{q}\sqrt{2*I1*\beta f}*\ln(N) \tag{3}$$

Solving for I1 arrives at relationship (4).

$$I1 = \left(\frac{k*T}{q}*\ln(N)\right)^2*2*\beta f \tag{4}$$

According to relationship (4), the current provided by the reference current source 200 depends only on βf when the temperature is constant. βf is generally the best controlled process parameter for MOSFETs. As such, at a constant temperature, the current provided by the reference current source 200 will operate within the process variation of βf (i.e., μCoxW/L). In some processes, the current variation of the reference current source 200 will be within 10% of the nominal current output.

As shown by relationship (4), the current provided by the reference current source 200 is still dependent on the temperature T. As such, the current provided by the reference current source 200 will vary as the operating temperature changes. βf also varies with temperature because μ varies with temperature, as provided by relationship (5).

$$\mu(T) = \mu_0\left(\frac{T_0}{T}\right)^p \tag{5}$$

where,

μ(T) is the value of μ at temperature T;

$\mu_0$ is the mobility at reference temperature $T_0$;

T is the temperature in Kelvin; and p is process dependent parameter, which is provided by the MOSFET manufacturer, and can be between 1.3 and 2.0.

The temperature dependence of the reference current source 200 can be determined by inserting the temperature dependence of βf into relationship (3), as shown by relationship (6).

$$I1 = \left(\frac{k*T}{q}*\ln(N)\right)^2 *2*\beta f_0*\left(\frac{T_0}{T}\right)^p \tag{6}$$

Relationship (6) reduces to arrive at relationship (7).

$$I1 = \left(\frac{k*T_0^{\frac{p}{2}}}{q}*\ln(N)\right)^2 *2*\beta f_0*T^{2-P} \tag{7}$$

As provided by relationship (7), the temperature dependence of the reference current source 200 depends on the process dependent parameter p, which will vary among different types of MOSFETs and processes. However, for purposes of example, assume that the value of p=1.8, which is in the typical range of p values. In this example, the temperature dependence of the reference current source 200 is $T^{0.2}$ (i.e., $T^{(2-1.8)}$), which is a weak positive dependence on temperature.

Figure 3:
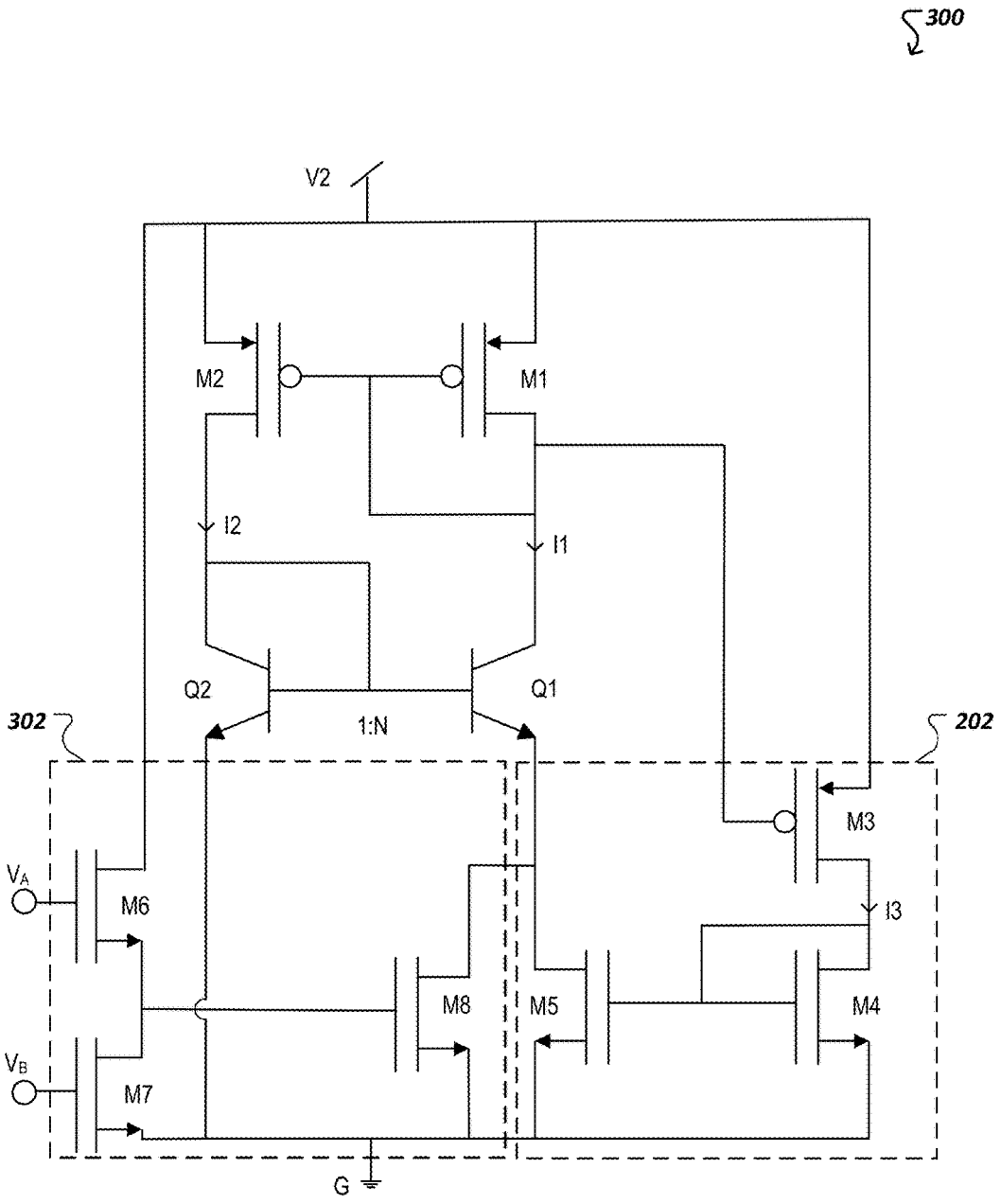
FIG. 3 is a schematic of another example reference current source.

FIG. 3 is a schematic of another example reference current source 300. The reference current source 300 is similar to the reference current source 200, but includes a voltage controlled resistor circuit 302 in parallel with the current controlled resistor 202.

The voltage controlled resistor circuit 302 includes three MOSFETs M6, M7, and M8, which are interconnected as shown in FIG. 3. More specifically, M8 has its drain connected to the emitter of Q1 and the drain of M5, while M8's source is connected to ground G. M6 has its drain connected to the voltage source V2 for the current generator circuit, and has its gate connected to a first current control voltage source $V_A$. The source of M6 is connected to the drain of M7, and both are connected to the gate of M8. M7 has its source connected to ground G, while its gate is connected to a second current voltage source $V_B$.

The equivalent resistance of the voltage controlled resistor circuit 302 is provided by relationship (7).

$$RM8 = \frac{1}{\beta f*N_{8:6}*\left(V_A - \sqrt{N_{7:6}}*V_B\right)} \tag{7}$$

where,

RM8 is the drain to source resistance of M8 in the voltage controlled resistor circuit 302;

$N_{7:6}$ is the (W/L) ratio of M7 to M6 (i.e., $W/L_{M7}/W/L_{M6}$);

$N_{8:6}$ is the (W/L) ratio of M8 to M6; and $V_A$ and $V_B$ are set to keep M6 and M7 in saturation, while keeping M8 in triode.

In the reference current circuit 300, the drain to source resistance of M5 can be expressed as shown in relationship (8).

$$RM5 = \frac{1}{N_{5:4}\sqrt{2*\beta f*I_3}} \tag{8}$$

where, $N_{5:4}$ is the (W/L) ratio of M5 to M4.

Therefore, the equivalent resistance of M5 and M8, which are connected in parallel, is provided by relationship (9).

$$\frac{1}{R_{EQ}} = \frac{1}{RM5} + \frac{1}{RM8} = N_{5:4}*\sqrt{2*\beta f*I_3} + N_{6:4}*N_{8:6}*\beta f*\left(V_A - \sqrt{N_{7:6}}*V_B\right) \tag{9}$$

where,

N5:4 is the (W/L) ratio of M5 to M4 (i.e., $W/L_{M5}/W/L_{M4}$);

N6:4 is the (W/L) ratio of M6 to M4;

N7:6 is the (W/L) ratio of M7 to M6;

N8:6 is the (W/L) ratio of M8 to M6;

βf is μ*Cox; and $V_A$ and $V_B$ are set to keep M6 and M7 in saturation, while keeping M8 in triode.

Relationship (9) can be used to solve for I3, as shown in relationship (10).

$$I_3 = N_{3:1}*\frac{k*T*\ln(N)}{q*R_{EQ}} \tag{10}$$

Replacing $R_{EQ}$ based on relationship (9), rearranging terms, and defining constants $L_1$ and $L_2$ provides relationship (11).

$$I_3 = Bf\frac{\left(N_{3:1}\frac{kT}{q}\ln(N)\right)^2}{2}*\left[L_1^2 + \frac{2L_2}{N_{3:1}\frac{kT}{q}\ln(N)} + \sqrt{L_1^4 + \frac{4L_2L_1^2}{N_{3:1}\frac{kT}{q}\ln(N)}}\right] \tag{11}$$

where, $$L_1 = \sqrt{2(N_{5:4})^2}\text{; and}$$

$$L2 = N_{6:4}N_{8:6}\left(V_A - \sqrt{N_{8:6}}\,V_B\right).$$

Adding the temperature dependence of βf to relationship (11) provides relationship (12) below.

$$I_3(T) = \beta f_0\left(\frac{kT_0^{\frac{p}{2}}}{q}\right)$$

-continued $$\frac{(N_{3:1}\ln(N))^2}{2} * \left[ L_1^2 T^{2-p} + \frac{2L_2 T^{1-p}}{N_{3:1}\frac{kT}{q}\ln(N)} + T^{2-p}\sqrt{L_1^4 + \frac{4L_2 L_1^2}{N_{3:1}\frac{kT}{q}\ln(N)}} \right]$$

Figure 4A:
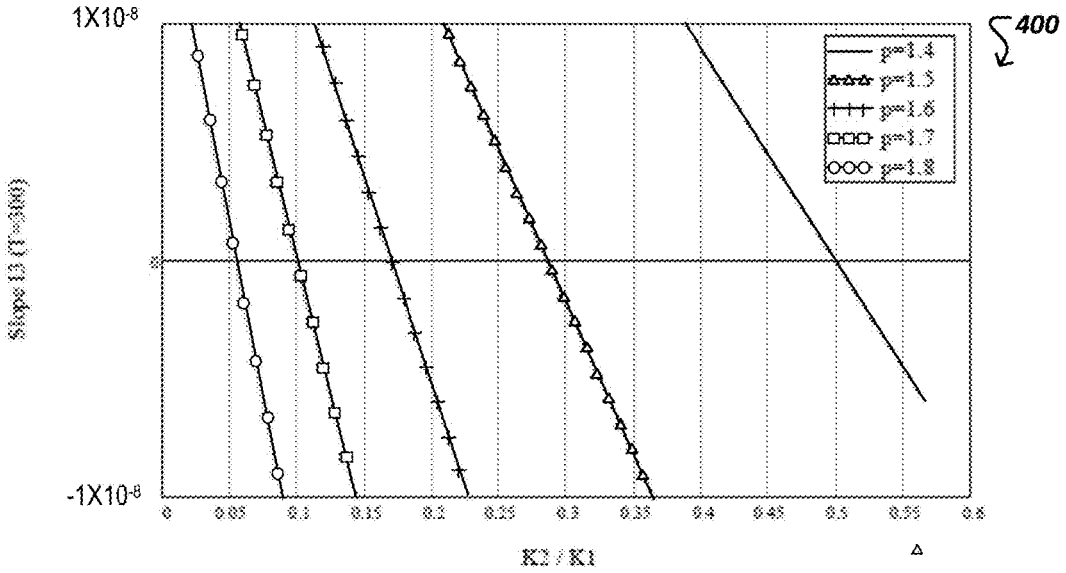
FIG. 4A is a graph showing the slopes of $I_3$ for different $L_2/L_1$ ratios.

Relationship (12) includes temperature dependent terms proportional to $T^{(2-p)}$ and $T^{(1-p)}$. Therefore, when p is between 1 and 2, the temperature dependence of the reference current source 300 can be tuned by changing the ratio of $L_2$ to $L_1$. For example, various ratios of $L_2/L_1$ can be evaluated at a given temperature (e.g., T=300K) to identify one or more ratios that make the slope of $I_3(T)$ equal to zero. FIG. 4A is a graph 400 showing, for various values of p, the slopes of $I_3$ resulting from various ratios of $L_2/L_1$. For example, when the p value is 1.8, the slope of $I_3(T)$ is equal to zero when the $L_2/L_1$ ratio is near 0.054. Similarly, when the p value is 1.4, the slope of $I_3(T)$ is equal to zero when the $L_2/L_1$ ratio is near 0.5. Note that FIG. 4A was created based on the following conditions: $T=T_0=300°$ K, $L_1=7.071$, N=8, $N_{3:1}=1$, $\beta f_0=180e\text{-}6$, k=1.38e-23, and q=1.6e-19.

Based on a graph similar to that presented in FIG. 4A, an $L_2/L_1$ ratio can be chosen to achieve a desired temperature dependency (or independency) for the reference current source 300. For example, by choosing an $L_2/L_1$ ratio that results in an $I_3(T)$ slope that is near zero, the reference current source 300 will be tuned to have a current output that is temperature independent Similarly, the reference current source 300 can be tuned to have a positive temperature dependency by selecting an $L_2/L_1$ ratio that results in a positive $I_3(T)$ slope, and the reference current source 300 can be tuned to have a negative temperature dependency by selecting an $L_2/L_1$ ratio that results in a negative $I_3(T)$ slope.

Although there are combinations of $L_2/L_1$ ratios and p values that provide a zero slope for $I_3(T)$ at a given temperature, there may still be some residual temperature variation that occurs over a wide range of temperatures. However, this residual temperature variation is significantly less than that of various current sources realized by other means.

Figure 4B:
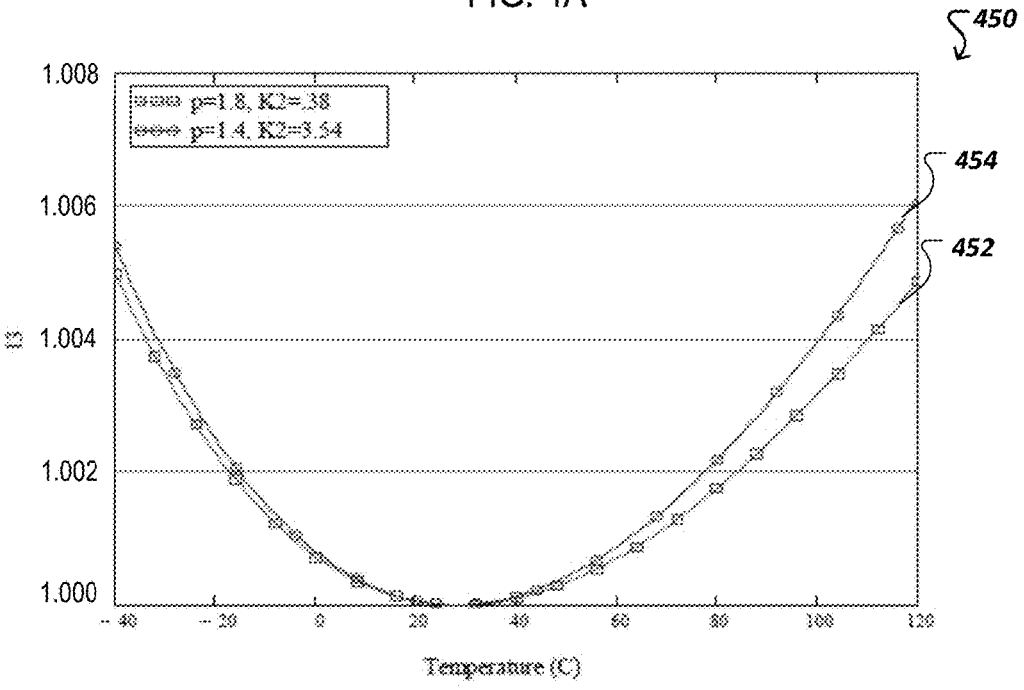
FIG. 4B is a graph showing $I_3(T)$ variations over a range of operating temperatures.

FIG. 4B is a graph 450 showing $I_3(T)$ variations over a range of operating temperatures. For example, the curve 452 shows the $I_3(T)$ variations over the temperature range of −40 degrees Celsius to +120 degrees Celsius when the p value is 1.8, the $L_2$ value is 0.38, and the $L_1$ value is 7.071. Meanwhile, curve 454 shows the $I_3(T)$ variations over the temperature range of −40 degrees Celsius to +120 degrees Celsius when the p value is 1.4, the $L_2$ value is 3.54, and the $L_1$ value is 7.071. According to FIG. 4A, these p value and $L_2/L_1$ ratio combinations each correspond to an $I_3(T)$ slope of zero at 300° K (27° C.). FIG. 4B shows that there is some current variation over this range of operating temperatures. However, the variation shown in FIG. 4B is on the order of approximately 0.6%, which is substantially better than the variation that would be otherwise experienced.

Example circuits have been provided for purposes of example, but the use of these examples is not intended to limit the scope of the claimed subject matter. For example, specific combinations of various device characteristics (e.g., size ratios, p values, βf values, etc.) have been referred to and used to describe the claimed technology, but other combinations of device characteristics can be used. In particular, different $L_2/L_1$ ratios and/or different $N_{x:y}$ ratios than those discussed above can be used.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A reference current source, comprising:

a current generator circuit; and a resistance circuit connected to the current generator circuit, wherein the resistance circuit comprises a current controlled resistance circuit and a voltage controlled resistance circuit that is connected in parallel with the current controlled resistance circuit, wherein the voltage controlled resistance circuit comprises a first plurality of MOSFETs, and wherein the first plurality of MOSFETs comprise:

a first MOSFET having a drain connected to an emitter of a bipolar transistor of the current generator, and having a source connected to ground;

a second MOSFET having a drain connected to a voltage source of the current generator and a gate connected to a first current control voltage source; and a third MOSFET having a source connected to ground and a gate connected to a second current control voltage source, wherein a drain of the third MOSFET is connected to each of a drain of the second MOSFET and a gate of the first MOSFET.

2. The reference current source of claim 1, wherein the current controlled resistance circuit comprises a second plurality of MOSFETs.

3. The reference current source of claim 2, wherein the second plurality of MOSFETs comprise:

a fourth MOSFET having a drain connected to each of the drain of the first MOSFET and the emitter of the bipolar transistor, and having a source connected to the ground;

a fifth MOSFET having a source connected to the voltage source of the current generator and a gate connected to the current generator; and a sixth MOSFET having a source connected to ground and a gate connected to each of a gate of the fourth MOSFET, a drain of the fifth MOSFET, and a drain of the sixth MOSFET.

4. The reference current source of claim 1, wherein the current controlled resistance circuit has a positive temperature dependency.

5. The reference current source of claim 4, wherein the voltage controlled resistance circuit has a negative temperature dependency.

6. The reference current source of claim 5, wherein the current controlled resistance circuit and the voltage controlled resistance circuit are respectively configured so that a combination of the positive temperature dependency and the negative temperature dependency configure the reference current source to be temperature independent.

7. The reference current source of claim 5, wherein the current controlled resistance circuit and the voltage controlled resistance circuit are respectively configured so that a combination of the positive temperature dependency and the negative temperature dependency configure the reference current source to have a positive temperature dependence.

8. The reference current source of claim 5, wherein the current controlled resistance circuit and the voltage controlled resistance circuit are respectively configured so that a combination of the positive temperature dependency and the negative temperature dependency configure the reference current source to have a negative temperature dependence.

9. The reference current source of claim 1, wherein the current generator circuit comprises a PTAT current generator circuit.

10. A reference current source comprising:

a current generator circuit;

a current controlled resistance circuit that has a positive temperature dependence; and a voltage controlled resistance circuit that has a negative temperature dependence, wherein the current controlled resistance circuit and the voltage controlled resistance circuit are connected in parallel to the current generator circuit, and wherein an L2/L1 ratio and a p value for MOSFETs of the reference current source are selected to provide a zero current slope at a given temperature.

11. A reference current source, comprising:

a current generator circuit; and a resistance circuit connected to the current generator circuit, wherein the resistance circuit comprises a current controlled resistance circuit and a voltage controlled resistance circuit, the current controlled resistance circuit connected to a voltage source of the current generator circuit, the voltage controlled resistance circuit connected to the voltage source of the current generator circuit, a first current control voltage source, and a second current control voltage source.

* * * * *